US006264244B1

(12) United States Patent
Isennock et al.

(10) Patent No.: US 6,264,244 B1
(45) **Date of Patent: *Jul. 24, 2001**

(54) END CONNECTOR FOR COMPOSITE COILED TUBING

(75) Inventors: Clint W. Isennock; Dickey C. Headrick; Scott A. Berning, all of Duncan, OK (US)

(73) Assignee: Halliburton Energy Services, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/067,978

(22) Filed: Apr. 29, 1998

(51) Int. Cl.[7] ..... F16L 55/00

(52) U.S. Cl. ..... 285/55; 285/239; 285/333; 138/109

(58) Field of Search ..... 166/242.2, 242.6; 138/109; 285/55, 148.23, 148.18, 333, 355, 239, 370; 242/532.7

(56) References Cited

U.S. PATENT DOCUMENTS

| | | | | |
|---|---|---|---|---|
| 1,062,155 | * | 5/1913 | Harris | 285/55 |
| 2,907,589 | * | 10/1959 | Knox | 285/355 X |
| 3,307,860 | * | 3/1967 | Blount et al. | 285/55 |
| 3,508,771 | * | 4/1970 | Duret | 285/355 X |
| 3,685,860 | | 8/1972 | Schmidt | 285/249 |
| 3,907,335 | | 9/1975 | Burge et al. | 285/23 |
| 4,032,177 | | 6/1977 | Anderson | 285/24 |
| 4,530,379 | | 7/1985 | Policelli | 138/109 |
| 4,936,618 | | 6/1990 | Sampa et al. | 294/86.31 |
| 5,156,206 | | 10/1992 | Cox | 166/242 |
| 5,184,682 | | 2/1993 | Delacour et al. | 166/385 |
| 5,251,695 | * | 10/1993 | Coronado | 166/242.6 |
| 5,314,014 | * | 5/1994 | Tucker | 166/242.6 X |
| 5,348,096 | | 9/1994 | Williams | 166/384 |
| 5,351,752 | | 10/1994 | Wood et al. | 166/68 |
| 5,425,420 | * | 6/1995 | Pringle | 166/242.6 |
| 5,469,916 | * | 11/1995 | Sas-Jaworsky et al. | 166/64 |
| 5,516,158 | * | 5/1996 | Watts | 285/333 |
| 5,566,984 | * | 10/1996 | Abbema et al. | 285/55 X |
| 5,895,079 | * | 4/1999 | Carstensen et al. | 285/333 |
| 5,984,370 | * | 11/1999 | Lewis | 285/370 X |
| 5,996,636 | * | 12/1999 | Fukano et al. | 285/370 X |

FOREIGN PATENT DOCUMENTS

| | | |
|---|---|---|
| 97/12115 | 4/1997 | (WO) . |
| 97/36087 | 10/1997 | (WO) . |

* cited by examiner

*Primary Examiner*—Lynne H. Browne
*Assistant Examiner*—Greg Binda
(74) *Attorney, Agent, or Firm*—William E. Shull; Michael D. McCully

(57) ABSTRACT

An end connector for fuse with composite coiled tubing for use in downhole wellbore operations is disclosed. The connector comprises intermediate portions of first and second end portions connected thereto. The first end portion has threads defined thereon to mate with threads defined on the inner surface of the composite coiled tubing. The outer surface of the end connector is flush with the outer surface of a composite coiled tubing when connected thereto. The connector has a means for providing a seal between the end connector and the composite coiled tubing and is adapted to be connected to apparatus, tools and equipment used in downhole wellbore operations in which coiled tubing is utilized.

15 Claims, 6 Drawing Sheets

END CONNECTOR FOR COMPOSITE COILED TUBING

BACKGROUND OF THE INVENTION

This invention relates to a connector for coiled tubing and more particularly to an end connector for composite coiled tubing to adapt the composite coiled tubing to be connected to various types of apparatus or equipment used in downhole operations in a wellbore.

Reeled or coiled tubing has been run into wells for many years for performing certain downhole operations, including, but not limited to, washing out sand bridges, circulating treating fluid, setting downhole tools, cleaning the internal walls of well pipes, conducting production fluids or lift gas, and a number of other similar remedial or production operations.

Conventionally, coiled tubing is made of steel. Although steel has been and is useful in such downhole operations, other materials are available which provide certain advantages over steel coiled tubing. For instance, coiled tubing may be made from a nonferrous material which will not suffer from some of the structural limitations of steel tubing and which is more resistant to chemicals. Coiled tubing may thus be made from fibrous composite material which results in a composite coiled tubing that is not as heavy as steel coiled tubing, provides greater corrosion resistance and has a longer fatigue life.

Such composite coiled tubing used in wellbore operations may be exposed to external pressures in excess of 5000 psi, and internal pressures as high as 15,000 psi. Tension and compression forces caused by the tubing being forced into or pulled out of a wellbore may exceed 60,000 lbf.

In order to perform the various wellbore operations, it is usually necessary to make connections between the composite coiled tubing and different types of apparatus or equipment used in downhole operations. The connection must be capable of handling the severe loads and pressures experienced during such operations. Numerous known connectors and connecting techniques, such as welding, are utilized with steel coiled tubing. Welding is not an option with composite coiled tubing and steel tubing connectors, like that described in U.S. Pat. No. 4,936,618 to Sampas et al., are not applicable to the composite coiled tubing being developed for use in downhole operations.

One type of end connector for use with composite coiled tubing is disclosed in application Ser. No. PCT/US96/15427. The connector shown there includes a load collar and housing arrangement disposed about the outer surface of the composite coiled tubing. Although the connector shown therein may provide an adequate structural connection capable of handling the extreme conditions that may exist in a wellbore, there are circumstances when such a connector cannot be used. For example, there may be circumstances where it is desirable to use composite coiled tubing in downhole operations where the inner diameter of the casing, production tubulars, or other downhole apparatus through which the tubing must pass, is such that a connector having a diameter greater than the tubing would cause an unacceptable amount of interference as the tubing is lowered into or raised from the wellbore. Similar difficulties may not occur with respect to steel coiled tubing, since steel tubing typically will have a thinner wall than composite coiled tubing connector.

This invention resolves any such difficulty by providing an end connector having an outer surface that is substantially flush with the outer surface of the composite coiled tubing when connected thereto, so that composite coiled tubing can be used in virtually any wellbore for which steel coiled tubing having the same inner diameter would be used, without causing any interference problems with the inner walls of the casing or production tubulars.

SUMMARY OF THE INVENTION

The present invention relates to an end connector for connecting the end of a composite coiled tubing to various tools and apparatus used in downhole wellbore operations. The invention is also directed to a method for providing a connection means to the end of composite coiled tubing.

The composite coiled tubing is spoolable and may be supplied on a large drum or reel, and is comprised of an outer composite structure containing several plies of high strength and stiffness fibers embedded in a resin material such as epoxy. The fibers are oriented to resist internal and external pressure and provide low bending stiffness. Fibers of high strength and modulus are embedded and bonded into a matrix that keeps the fibers in position, acts as a load transfer medium and protects the fibers from environmental damage. The plastic binder in which the fibers are embedded to form the matrix will have an appropriate modulus of elasticity to enclose the composite coiled tubing to withstand the aforementioned downhole conditions. Typically, a liner may be employed in the tubing to serve as a structural member, one function of which is pressure containment to resist leakage of internal fluids within the tubing. A wear surface is employed as an outer layer and may be comprised of a binder containing particles of a tough material.

The end connector for the composite coiled tubing is insertable into the end of the composite coiled tubing and is connectable thereto. The end connector has an outer surface defining an outer diameter, or periphery that is substantially flush with, or radially recessed inwardly from the outer diameter or periphery defined by the outer surface of the composite coiled tubing. In other words, the outer surface of the end connector defines an outer diameter having a magnitude that may be substantially equal to or less than the magnitude of the outer diameter defined by the composite coiled tubing, but which may not be greater than the composite coiled tubing outer diameter.

The end connector may comprise a connector body having a first end portion, an intermediate portion and a second end portion wherein the first end portion is insertable into the end of the composite coiled tubing. Preferably, the first end portion is threadably connectable with an inner surface of the composite coiled tubing.

Thus, the first end portion may include a threaded section which will engage threads defined on the inner surface of the composite coiled tubing. The end connector may also include a second end portion adapted to be connected to any apparatus, tool, or other equipment used in downhole wellbore operations. The terms apparatus, tool and/or equipment, when used in reference to what is being connected to the end connector, is all inclusive and shall be considered to include any and all couplings, connectors, adapters, tools and apparatus that might be attached to coiled tubing for use in connection with downhole operations, including couplings utilized to connect the second end portions of two end connectors, each being attached to a length of composite coiled tubing, thus connecting two lengths of composite tubing. The second end portion may therefore have threads defined on either the outer or the inner surface thereof, thereby adapting the end of the composite coiled tubing to be connected to any conventional apparatus or equipment.

The first end portion may further include a seal section. The threaded section of the first end portion is preferably positioned between the intermediate portion of the end connector and the seal section of the first end portion. Thus, when the end connector is threaded into an end of composite coiled tubing, the seal section will extend into a central opening defined by the composite coiled tubing, and will preferably extend into and sealingly engage the liner disposed in the composite coiled tubing, thus providing a sealing means to seal between the end connector and the composite coiled tubing. The seal section provides a fluid-tight seal between the end connector and the composite tubing by providing a fluid-tight seal between the seal section and the liner disposed therein.

The first end portion of the connector extends away from the intermediate portion in a first direction and the second end portion extends away from the intermediate portion in a second direction. Preferably, the intermediate portion defines the outer diameter of the end connector.

The end connector has a central opening which is communicated with the central opening of the composite coiled tubing when the end connector is connected thereto. Thus, the central openings of the end connector and the composite coiled provide a central flow passage for the passage of fluids therethrough including production fluid to be conducted to the surface when the composite coiled tubing is used as a production tubing.

No connectors similar to the invention claimed herein are known, since it was not thought that the connection between an internally threaded composite coiled tubing and an externally threaded connector would handle the aforementioned extreme loads and pressures experienced in downhole wellbore operations. It was thought that the threads on the composite coiled tubing would strip, that the threaded connection would fail when the combination was used in downhole operations, or that the joint between the threads would seep or otherwise not hold internal and external pressure. However, the seal section and the threaded section defined on the end connector provide a connection between the end connector and composite coiled tubing that will provide a seal when exposed to the extreme pressures seen in a wellbore environment, and that will carry the loads that will be experienced. Thus, the end connector provides a means for being connected to an end of a composite coiled tubing, and for adapting the end of a composite coiled tubing to be connected to apparatus used in downhole operations.

DETAILED DESCRIPTION OF A PREFERRED EMBODIMENT

Figure 1:
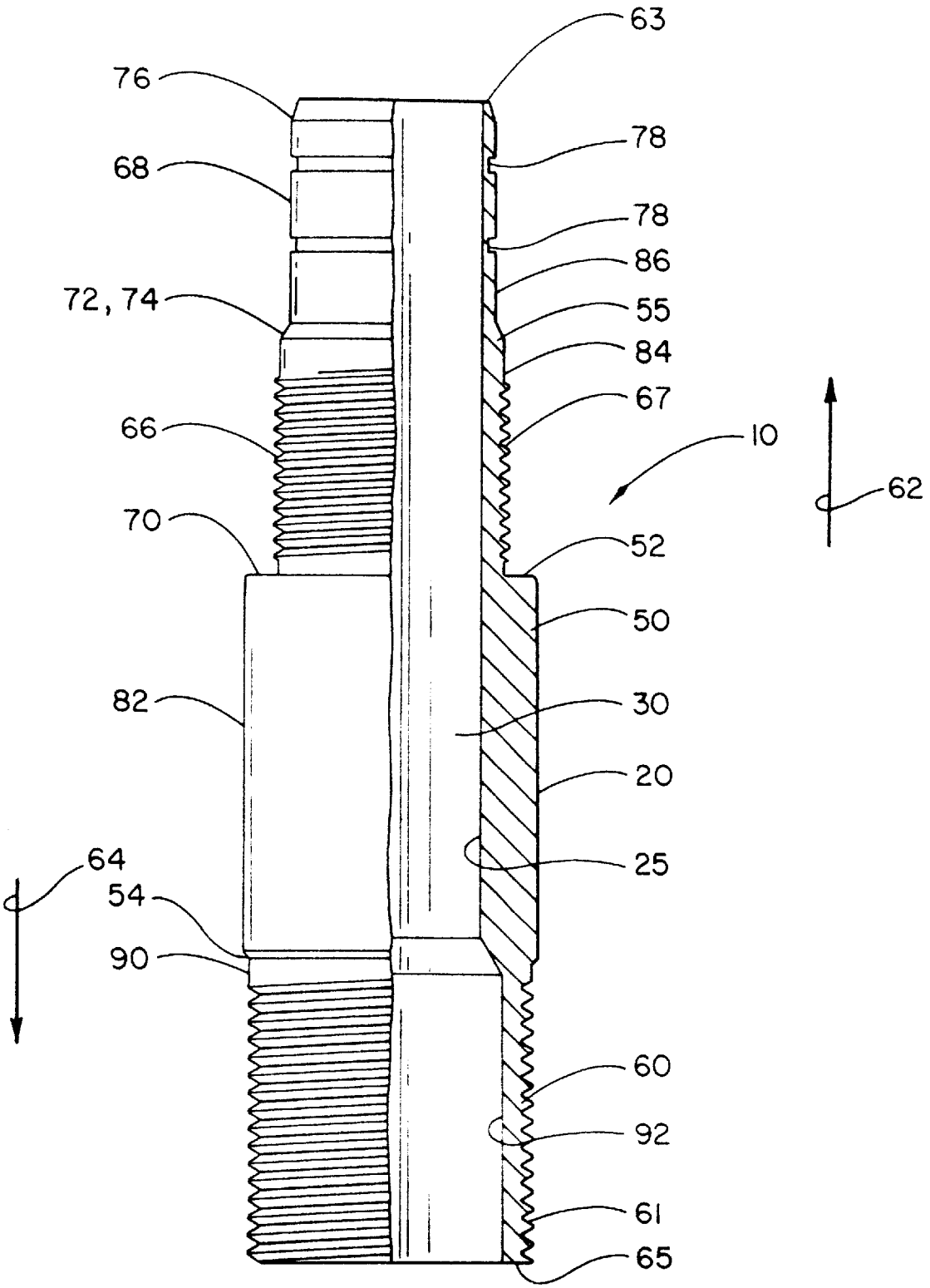
FIG. 1 shows a partial cross-sectional elevational view of the end connector of the present invention.

Referring now to the drawings and more particularly to FIGS. 1 and 2, an end connector, or coupling 10 for a composite coiled tubing 15 is shown. Composite coiled tubing 15 can exceed the performance limitations of conventional steel coiled tubing, thus increasing the service life of the tubing. Composite coiled tubing is constructed as a continuous tube fabricated generally from non-metallic materials to provide high body strength and wear resistance. The fibers and resins used in composite coiled tubing construction make the composite coiled tubing corrosion resistant, and the service life potential of composite coiled tubing is substantially longer than that of conventional steel pipe when subjected to multiple plastic deformation bending cycles with high internal pressures.

High performance composite structures from which composite coiled tubing 15 can be made are generally constructed as a buildup of laminate layers with the fibers in each layer oriented in a particular direction or directions. These fibers are normally locked into a preferred orientation by a surrounding matrix material. The matrix material, normally weaker than the fibers, serves the critical role of transferring load into the fibers. Fibers having a high potential for application in constructing composite pipe include, but are not limited to, glass, carbon, and aramid. Epoxy or thermoplastic resins are good candidates for the matrix material.

Figure 2A:
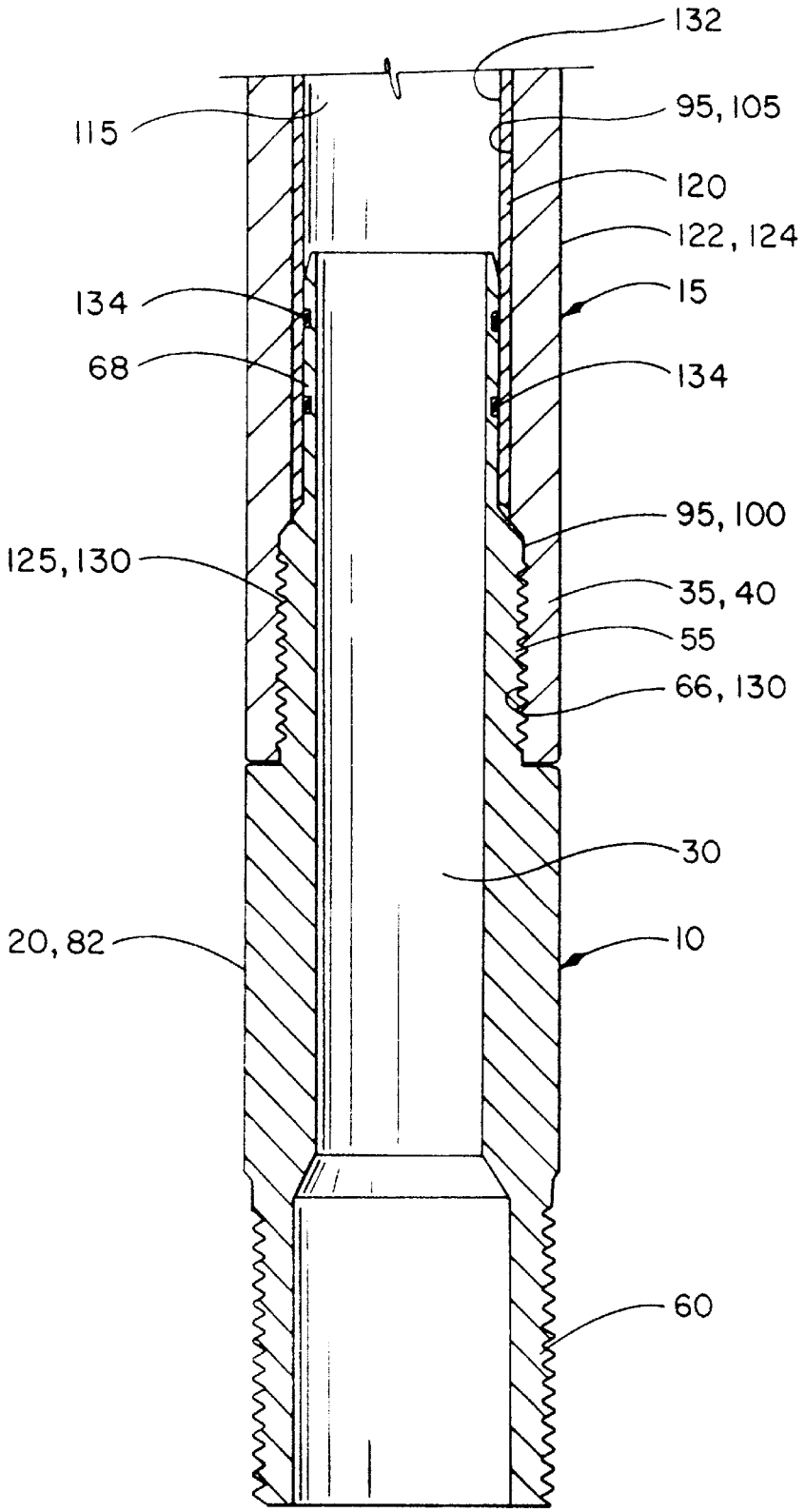
FIGS. 2A and 2B show a cross-sectional elevational view of the end connector of the present invention connected to the upper and lower ends of a composite coiled tubing.
Figure 2B:
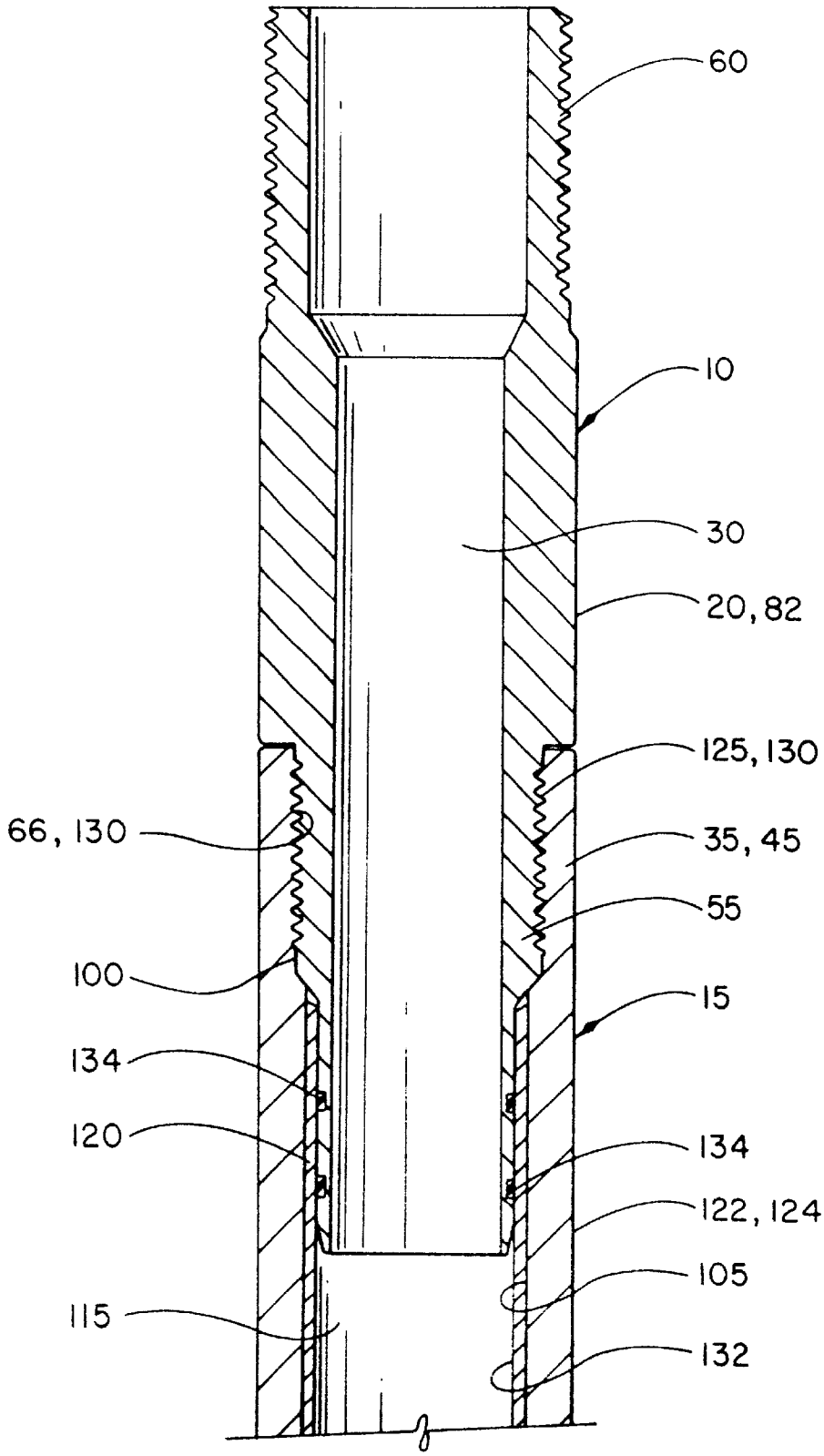

End connector 10, which may also be referred to as an apparatus for providing connection means to an end of a composite coiled tubing, or apparatus for providing connection means between a composite coiled tubing end and equipment used in downhole operations, has an outer surface 20 and an inner surface 25 defining a central opening 30 therethrough. End connector 10 is adapted to be connected to an end 35 of tubing 15 which may be a lower end 40 or an upper end 45 thereof as depicted in FIGS. 2A and 2B.

End connector 10 has an intermediate portion 50 having a first end 52 and a second end 54. End connector 10 may also include a first end portion or neck portion 55 and a second end or tool connection portion 60. Tool connection portion 60 may have threads 61 defined thereon. First end portion 55 extends away from first end 52 of intermediate portion 50 in a first direction 62 to an end or terminal point 63. Second end portion 60 extends away from second end 54 of intermediate portion 50 in a second direction 64 to an end or terminal point 65.

First end portion 55 has a threaded section 66 having threads 67 defined thereon between first and second ends 70 and 72 thereof, respectively. First end portion 55 also has a seal section 68 having first and second ends 74 and 76 respectively. Threaded section 66 is positioned on first end portion 55 between seal section 68 and first end 52 of intermediate portion 50. Seal section 68 may also have grooves 78 defined therein for receiving elastomeric seals as will be explained in more detail hereinbelow. A first or outer diameter 82 of end connector 10 is defined by outer surface 20. Outer diameter 82, which may also be referred to as outer periphery 82, is preferably defined on intermediate section 50.

End connector 10 may also have a second or threaded diameter 84. Second diameter 84 is defined on first end portion 55, and is recessed radially inwardly from outer diameter 82. A third, or seal diameter 86, which is recessed radially inwardly from second diameter 84 is defined by seal section 68. Grooves 78 are defined in seal diameter 86. A fourth diameter 90 may be defined by second end portion 60 and, as shown in FIG. 1 may have threads 61 defined thereon to provide means for connecting to an apparatus used in downhole operations. If preferred, second end portion 60 may be threaded on an inner diameter 92 thereof as opposed to fourth diameter 90. Thus, end connector 10 provides a means for connecting any apparatus or equipment used in downhole operations to the end of composite coiled tubing 15.

FIGS. 2A and 2B show the end connector 10 received in the ends 35 of a composite coiled tubing 15. As shown therein, the end connector is adapted to be received and connected in both the lower and upper ends 40 and 45 respectively of composite coiled tubing 15.

Composite coiled tubing 15 may have an inner surface 95 defining a first inner diameter 100 and a second inner diameter 105 recessed radially inwardly therefrom. A central opening 115 is defined by inner surface 95. A liner 120 may be disposed in composite coiled tubing 15, preferably in second inner diameter 105. Composite coiled tubing 15 further has an outer surface 122 defining an outer diameter 124.

End connector 10, and preferably the first end portion 55 thereof, is insertable and connectable in composite coiled tubing 15 at an end 35 thereof. Preferably, composite coiled tubing 15 has threads 125 defined on first inner diameter 100 at an end 35 thereof. End connector 10 may thus be threadably connected to composite coiled tubing 15 at a joint 130 between threads 67 defined on threaded section 66 and threads 125 defined on inner diameter 100 of composite coiled tubing 15. When end connector 10 is threaded into composite coiled tubing 15, seal section 68 extends axially into tubing 15 so that seal diameter 86 is closely received in and sealingly engages an inner diameter 132 of liner 120. A plurality of seals 134 are received in grooves 78, and sealingly engage liner 120. Thus, seal section 68 comprises a sealing means for providing a fluid-tight seal between end connector 10 and composite coiled tubing 15. Central opening 30 of end connector 10 is communicated with central opening 115 of composite tubing 15 thus providing a central flow passage for the production of fluids therethrough or for the flow of any fluid that may be utilized during downhole operations.

As shown in FIGS. 2A and 2B, outer surface 20 of end connector 15 is substantially flush with outer surface 122 of composite coiled tubing 15 when connected thereto. More specifically, outer diameter 82 defined by outer surface 20 on intermediate portion 50 is preferably substantially the same as outer diameter 124 defined by outer surface 122 of composite coiled tubing 15. Although diameters 82 and 122 are depicted as having substantially the same magnitude, the end connector 10 may define an outer diameter having a magnitude that is less than the outer diameter defined by the composite coiled tubing 15. Thus, outer surface 20 of end connector 10 may be flush with, or radially recessed inwardly from outer surface 122 of the composite coiled tubing, and the outer diameter defined by the end connector may have a magnitude that is substantially equal to, or less than the magnitude of outer diameter defined by the composite coiled tubing. The outer diameter of the end connector may therefore be flush with or is recessed radially inwardly from the outer diameter of the composite coiled tubing.

The end connector thus provides a means for connecting coiled tubing 15 to any apparatus used in downhole operations. The end connector 10, and apparatus to be attached thereto may be connected to the lower end 40 in conventional fashion.

Figure 4:
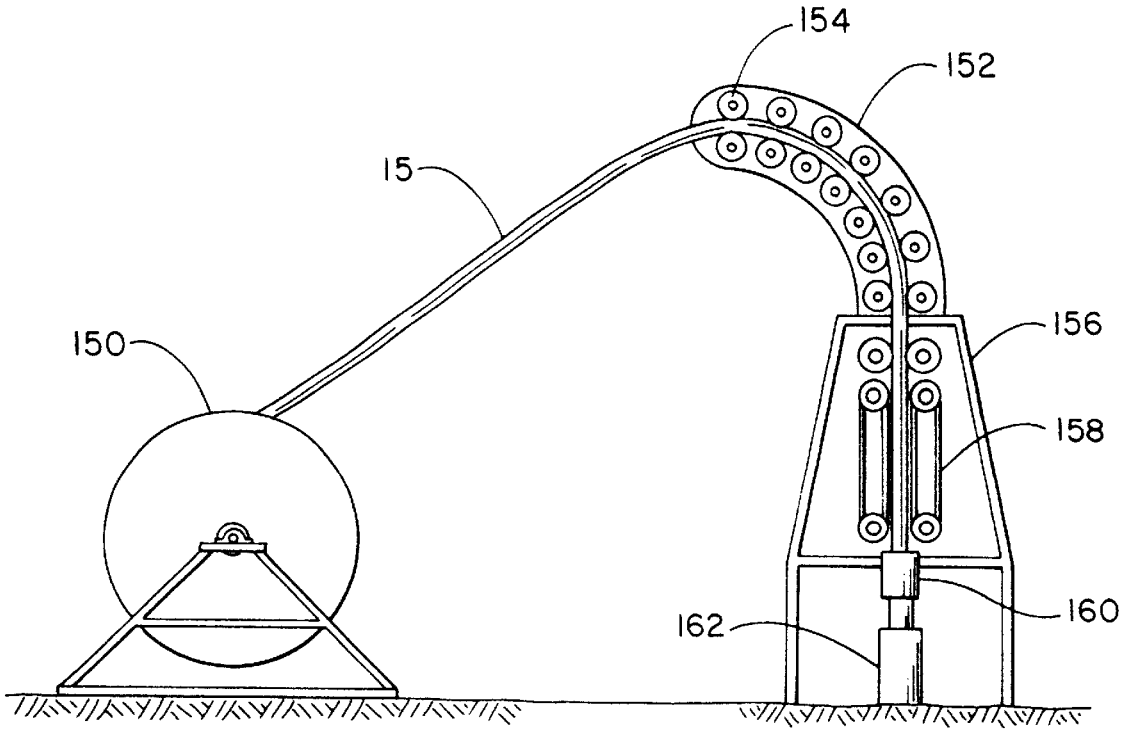
FIG. 4 shows a schematic of a coiled tubing injector mounted above a wellhead.

For example, as shown schematically in FIG. 4, composite coiled tubing may be spooled from a drum or reel 150. A tubing guide, or framework 152 supports a number of rollers 154 which define a pathway for composite coiled tubing 15. Tubing guide 152 guides the tubing into a tubing injector 156 which may have opposed drive chains 158 with a plurality of gripper blocks (not shown) attached thereto for engaging the composite coiled tubing 15. Such injectors are well known in the art, and will inject or withdraw the tubing from a wellbore. FIG. 4 schematically shows tubing 15 being injected into a wellbore through a stuffing box or lubricator 160 at the wellhead 162. The entry through the stuffing box or lubricator provides a seal about the outer diameter of the tubing. All of such equipment is well known in the art. Several other types of apparatus known in the art may be present above the surface and below the injector, and have been left out for clarity.

Figure 5:
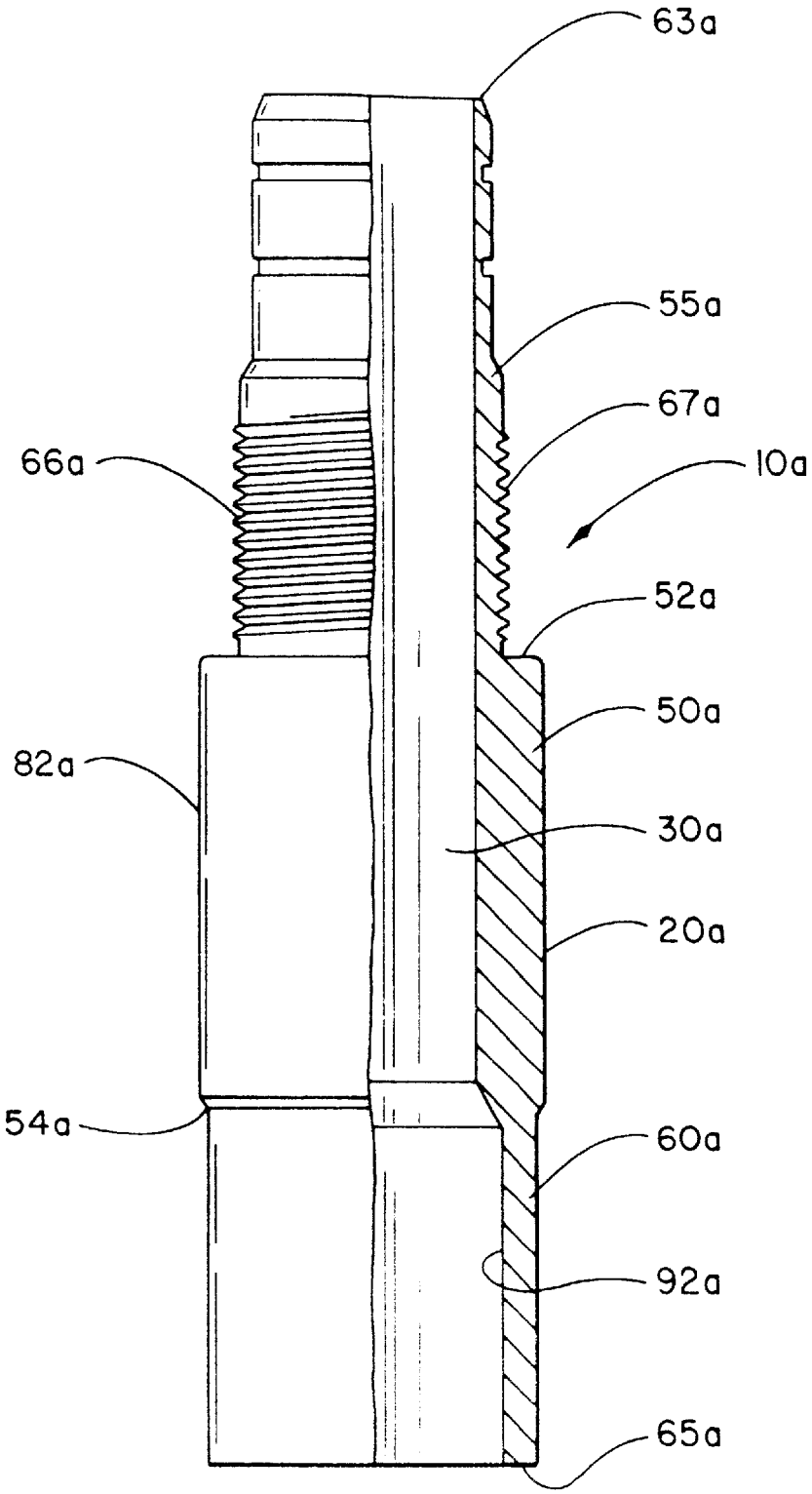
FIG. 5 shows a partial cross-sectional elevational view of a dummy end connector of the present invention.

After the end 40 of composite coiled tubing passes through injector 156, the end connector 10 and apparatus to be attached to second end portion 60, is connected thereto. The end of the composite coiled tubing 15 may be inserted directly into and through the injector 156. Alternatively, a dummy connector 10*a*, as shown in FIG. 5, may be threaded into the end of composite coiled tubing 15 and inserted through injector 156. Dummy connector 10*a* may be identical to end connector 10, except it has no threads on the outer surface of second section 60*a*. Once the end of composite coiled tubing 15 passes through the injector 156, dummy connector 10*a* is removed from the end of the composite coiled tubing, and an end connector 10, along with the apparatus necessary to perform the desired downhole operation is connected thereto.

Figure 3:
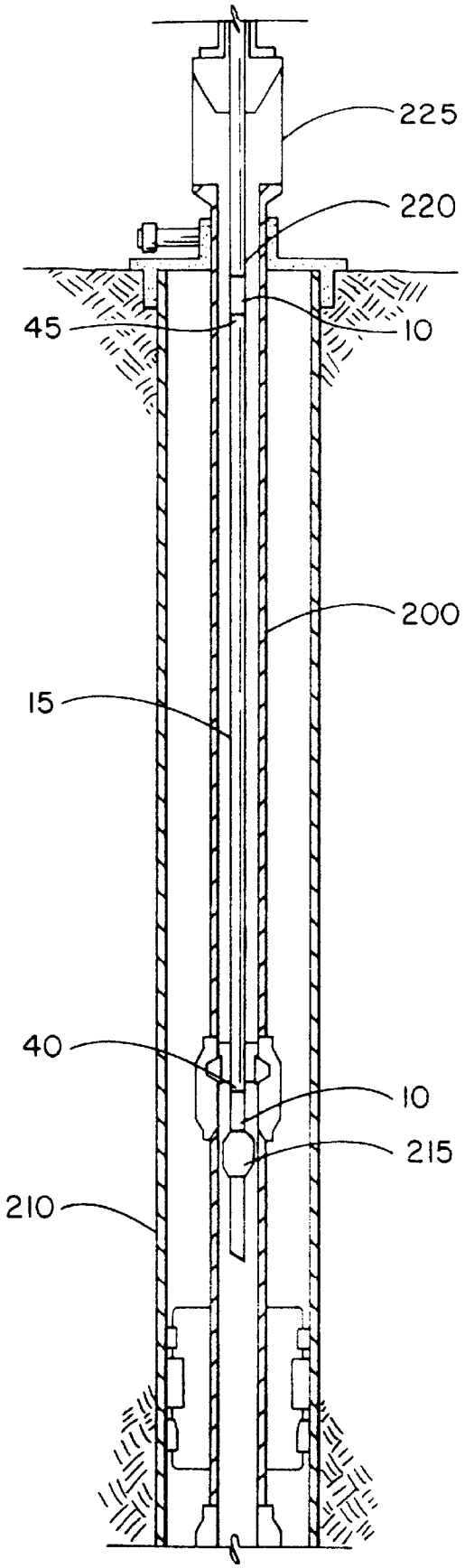
FIG. 3 shows a schematic of a composite coiled tubing disposed in a wellbore.

As shown schematically in FIG. 3, composite coiled tubing 15 may be used as production tubing disposed in jointed production tubulars 200 in a wellbore 210, for the production of hydrocarbons or other production fluids, or other service and workover operations. An end connector 10 connected to the lower end 40 of the composite coiled tubing may have a landing nipple, tool or other known equipment 215 utilized in downhole operations connected thereto. A second end connector 10 may be connected at the upper end 45 of the composite coiled tubing 15 and may have an adapter 220 or other coupling connected thereto to which steel or other tubing thereabove can be connected and utilized in a typical coiled tubing hanger configuration at the wellhead such as conventional slips 225. Upper end 45 of composite coiled tubing 15 may utilize a connection for numerous other applications and operations involving coiled tubing. Second end portions 60 of two end connectors 10 may also be connected together with a threaded coupling, wherein the first end portion 55 of each connector is connected to an end of a length of composite coiled tubing, thereby splicing, or connecting two lengths of composite coiled tubing together. End connectors 10 may be used to splice together as many lengths of composite coiled tubing as would be necessary to conduct the desired downhole wellbore operation.

A method for providing end connection means to a composite coiled tubing is thus provided. The method comprises the steps of inserting an end connector into the end of the composite coiled tubing wherein the end connector is adapted to be connected to wellbore equipment used in downhole operations. The method also comprises threading the inner surface of the composite coiled tubing at the end thereof and threading the end connector into the composite coiled tubing.

The outer surface of the end connector defines a diameter having a magnitude not greater than the magnitude of the diameter defined by the composite coiled tubing. The method may further comprise the step of providing a seal between the end connector and the composite coiled tubing by inserting the connector into the tubing until it engages a liner disposed in the composite coiled tubing.

Although the invention has been described with reference to a specific embodiment, the foregoing description is not intended to be construed in a limiting sense. Various modifications as well as alternative applications will be suggested to persons skilled in the art by the foregoing specification and illustrations. It is contemplated that the appended claims will cover any such modifications, applications or embodiments as followed in the true scope of the invention.

What is claimed is:

1. An end connector for connecting composite coiled tubing to equipment used in downhole wellbore operations, the end connector comprising:

a connector body having a central opening defined therethrough adapted to be communicated with a central opening of said composite coiled tubing, the connector body having an intermediate portion, a first end portion extending away from said intermediate portion in a first direction and a second end portion extending away from said intermediate portion in a second direction;

said first end portion having a threaded section adapted to be received and threadedly connected in said central opening of said composite coiled tubing;

said threaded section being a straight threaded section so that said threaded section will mate with and connect to said composite coiled tubing to make a threaded connection without deforming said composite tubing; and said second end portion being adapted to be connected to said equipment used in downhole operations wherein said threaded connection between said end connector and said composite coiled tubing will support said equipment used in said downhole operations.

2. The end connector of claim 1, said end connector having an outer surface defining an outermost diameter, wherein the outermost diameter of said end connector will not extend radially outwardly beyond an outer diameter defined by the composite coiled tubing, when said end connector is connected thereto.

3. The end connector of claim 2, said outmost diameter of said end connector being defined on said intermediate portion of said end connector.

4. The end connector of claim 1 wherein said first end portion comprises:

said threaded section adapted to be threaded into said composite coiled tubing; and a seal section extending away from said threaded section in said first direction for sealing between said composite coiled tubing and said end connector, wherein said seal section is generally cylindrically shaped and has a diameter recessed radially inwardly from a diameter of said threaded section, said seal section being adapted to sealingly engage a liner disposed in said composite coiled tubing.

5. The end connector of claim 1, said first end portion being adapted to provide a seal between said end connector and said composite coiled tubing.

6. A tool for moving apparatus used in downhole wellbore operations, the tool comprising:

a length of composite coiled tubing, the composite coiled tubing having a liner disposed therein;

an end connector connected to an end of said length of composite coiled tubing, the end connector comprising first and second end portions and an intermediate portion therebetween, said first end portion comprising a straight threaded section and a seal section extending axially from said straight threaded section, wherein said first end portion is inserted into said end of said composite coiled tubing and is threadedly connected therein without deforming said composite tubing, said seal section extending axially from said threaded connection to sealingly engage said liner, said second end portion including a connecting means for connecting to said apparatus used in said downhole wellbore operations, the end connector having an outer surface, wherein the radially outermost part of said outer surface of said end connector is substantially flush with or recessed radially inwardly from an outermost surface of said composite coiled tubing when said end connector is connected to said composite coiled tubing.

7. The tool of claim 6, wherein said end connector defines a central opening and wherein said central opening of said end connector communicates with a central opening defined by said composite coiled tubing.

8. An apparatus for use in a wellbore drilled for the production of hydrocarbons comprising:

a composite coiled tubing having an inner surface defining a central opening and having an outer surface, said inner surface of said composite coiled tubing having threads defined thereon; and an end connector, the end connector having a straight threaded section threadedly connected to said threads defined on the inner surface of said composite coiled tubing, said end connector having a seal section extending axially from said threads, wherein said seal section sealingly engages a liner disposed in said composite coiled tubing, said end connector being adapted to be connected to equipment used in downhole wellbore operations.

9. The apparatus of claim 8, said end connector having an outermost diameter, said outermost diameter having a magnitude equal to or less than the magnitude of an outermost diameter defined by said composite coiled tubing.

10. The apparatus of claim 8 wherein said composite coiled tubing has an upper end and a lower end, said composite coiled tubing having threads defined therein at both ends thereof, each end of said composite coiled tubing having a said end connector threadedly connected therein.

11. The apparatus of claim 8, wherein said end connector comprises:

a connector body having first and second end portions, said first end portion comprising said threaded section and said seal section for sealingly engaging said liner disposed in said composite coiled tubing, said second end portion being adapted to be connected to said equipment used in downhole wellbore operations.

12. The apparatus of claim 8, said end connector having a central opening wherein said end connector central opening communicates with the central opening of said composite coiled tubing.

13. The apparatus of claim 8, wherein said equipment used in downhole wellbore operations is supported in said wellbore substantially exclusively by said threaded connection between said connector and said composite coiled tubing.

14. The apparatus of claim 8, wherein said sealing section is generally cylindrically shaped and has a diameter recessed radially inwardly from a diameter defined by said straight threaded section.

15. The apparatus of claim 14, wherein said sealing section has at least one groove defined therein, said at least one groove having an elastomeric seal disposed therein for sealingly engaging said liner.

* * * * *